US009016355B2

(12) United States Patent
Hirai

(10) Patent No.: US 9,016,355 B2
(45) Date of Patent: Apr. 28, 2015

(54) COMPOUND TYPE HEAT EXCHANGER

(75) Inventor: Tadahiro Hirai, Kita-ku (JP)

(73) Assignee: Calsonic Kansei Corporation, Saitama-Ken (JP)

( * ) Notice: Subject to any disclaimer, the term of this patent is extended or adjusted under 35 U.S.C. 154(b) by 926 days.

(21) Appl. No.: 13/143,599

(22) PCT Filed: Jan. 7, 2010

(86) PCT No.: PCT/JP2010/050076

§ 371 (c)(1),
(2), (4) Date: Jul. 7, 2011

(87) PCT Pub. No.: WO2010/079796

PCT Pub. Date: Jul. 15, 2010

(65) Prior Publication Data

US 2011/0284186 A1 Nov. 24, 2011

(30) Foreign Application Priority Data

Jan. 9, 2009 (JP) ..... 2009-004082
Feb. 26, 2009 (JP) ..... 2009-044200

(51) Int. Cl.
*F28D 7/10* (2006.01)
*F28D 1/00* (2006.01)
(Continued)

(52) U.S. Cl.
CPC ..... *F28F 9/0234* (2013.01); *F01P 2060/02* (2013.01); *F28D 1/0461* (2013.01);
(Continued)

(58) Field of Classification Search
CPC ... F28D 1/0435; F28D 1/0426; F28D 1/0408; F28D 2021/0084; F28D 2021/0089
USPC ..... 165/104.19, 140, 148–151, 174, 916
See application file for complete search history.

(56) References Cited

U.S. PATENT DOCUMENTS 2,887,097 A 5/1959 Huffman, Sr. et al.
3,073,575 A * 1/1963 Schulenberg ..... 165/146
(Continued)

FOREIGN PATENT DOCUMENTS

CN 101115963 1/2008
DE 197 57 805 7/1999
(Continued)

OTHER PUBLICATIONS

International Search Report issued Mar. 16, 2010 in International (PCT) Application No. PCT/JP2010/050076.
(Continued)

*Primary Examiner* — Judy Swann
*Assistant Examiner* — Claire Rojohn, III
(74) *Attorney, Agent, or Firm* — Wenderoth, Lind & Ponack, L.L.P.

(57) ABSTRACT

In a compound type heat exchanger, a first heat exchanger includes a pair of tanks arranged a certain distance apart from each other and a core part having tubes and fins that are alternately piled up between the pair of tanks. One of the pair of tanks is composed of a plurality of divided bodies that are connected along a longitudinal direction of the one of the pair of tanks. One of the plurality of divided bodies is provided with an accommodation portion that projects outwardly to communicate with the one of the plurality of divided bodies. A second heat exchanger is arranged in the accommodation portion through an opening portion of the accommodation portion, which is provided with an input port. Heat is exchanged between an intake air of the first heat exchanger that flows in the accommodation portion and a coolant of the second heat exchanger.

20 Claims, 13 Drawing Sheets

(51) Int. Cl.

| | |
|---|---|
| ***F28D 1/04*** | (2006.01) |
| ***F28F 9/02*** | (2006.01) |
| *F28D 21/00* | (2006.01) |

(52) U.S. Cl.

CPC . *F28D2021/0082* (2013.01); *F28D 2021/0094* (2013.01); *F28F 9/0282* (2013.01); *F28F 2220/00* (2013.01); *Y10S 165/916* (2013.01)

(56) References Cited

U.S. PATENT DOCUMENTS

| | | | | | |
|---|---|---|---|---|---|
| 3,774,678 | A | * | 11/1973 | Glorisi | 165/76 |
| 4,903,491 | A | * | 2/1990 | Larinoff | 60/692 |
| 5,067,561 | A | * | 11/1991 | Joshi et al. | 165/140 |
| 6,755,158 | B2 | * | 6/2004 | Knecht et al. | 123/41.56 |
| 6,834,709 | B2 | * | 12/2004 | Shirota et al. | 165/43 |
| 6,988,541 | B2 | * | 1/2006 | Nakajima et al. | 165/140 |
| 7,516,779 | B1 | * | 4/2009 | Marcus | 165/140 |
| 8,112,993 | B2 | * | 2/2012 | Hummel et al. | 60/599 |
| 8,225,852 | B2 | * | 7/2012 | Wu et al. | 165/140 |
| 2006/0113068 | A1 | * | 6/2006 | Desai et al. | 165/140 |
| 2006/0278378 | A1 | * | 12/2006 | Okura et al. | 165/140 |
| 2007/0246201 | A1 | * | 10/2007 | Hori et al. | 165/140 |
| 2008/0169092 | A1 | | 7/2008 | Kardos | |

FOREIGN PATENT DOCUMENTS

| | | | | | |
|---|---|---|---|---|---|
| EP | 0 334 504 | | | 9/1989 | |
| FR | 2 645 209 | | | 10/1990 | |
| FR | 2 832 791 | | | 5/2003 | |
| GB | 2 375 388 | | | 11/2002 | |
| GB | 2375388 | A | * | 11/2002 | F02B 29/04 |
| JP | 59-145325 | | | 8/1984 | |
| JP | 3-19430 | | | 2/1991 | |
| JP | 4-73781 | | | 6/1992 | |
| JP | 11-62587 | | | 3/1999 | |
| JP | 2000-180089 | | | 6/2000 | |

OTHER PUBLICATIONS

Supplemental European Search Report issued Oct. 11, 2013 in corresponding European Application No. 10 72 9216.1.

European Office Action issued Dec. 10, 2014 in corresponding European Patent Application No. 10 729 216.1.

* cited by examiner

COMPOUND TYPE HEAT EXCHANGER

TECHNICAL FIELD

The present invention relates to a compound type heat exchanger where a first exchanger and a second heat exchanger are joined with each other.

BACKGROUND OF THE INVENTION

A Patent document 1 discloses a technology of a compound type heat exchanger. In this invention, a first heat exchanger contains a second heat exchanger.

Patent Document 1: U.S. Pat. No. 6,755,158

DISCLOSURE OF THE INVENTION

Problem(s) to be Solved by the Invention

However, in the prior invention, in a case where the temperature of the intake air flowing in the tubes of the first heat exchanger is different among them, a heat stress generates due to the uneven distribution of the temperature in the core portion and consequently the durability in the root portions of the tubes and others might deteriorate.

In order to remove the problem, the core part of the second heat exchanger needs to be arranged in a state where it is arranged near all of the tubes of the first heat exchanger so as to face thereto, as the second heat exchanger is contained in the first heat exchanger. This brings the second heat exchanger to be larger in size.

In other words, in a case where the entire length of the second heat exchanger is set shorter, a part of the flowing medium of the first heat exchanger flows in the tubes of the first heat exchanger without heat exchange with that of the second heat exchangers, and thereby the flowing medium with the temperature different in the tubes flows in. As a result, the heat stress generates due to the uneven distribution of the temperature, and thereby there is a possibility of the deterioration in its durability of the first heat exchanger.

Accordingly, there is a problem in that the design freedom of the first heat exchanger and the second heat exchanger is limited to a small extent and the design change of the first heat exchanger and the second heat exchanger is needed to a large extent for every kind thereof in a case of manufacturing many kinds of the first heat exchangers whose the heights of the core parts are different for examples.

The present invention is made to solve the above-described problem, and its object is to provide a compound type heat exchanger whose design freedom can be increased.

Means for Solving the Problems

The compound type heat exchanger of the present invention includes:

a first heat exchanger including a pair of tanks arranged a certain distance apart from each other and a core part having a plurality of tubes between the tanks, and a second heat exchanger, wherein at least one of tanks is constituted of a plurality of divided bodies that are connected along a longitudinal direction of the at-least one of the tanks, wherein a certain divided body of the plurality of divided bodies is provided with an accommodation portion that projects outwardly and is connected with the certain divided body, wherein the second heat exchanger is arranged in the accommodation portion, wherein the accommodation portion is provided with a connection port as a gateway of the flowing medium of the first heat exchanger, and wherein heat is exchanged between the flowing medium of the first heat exchanger that flows thorough the accommodation portion and a flowing medium of the second heat exchanger.

Effect of the Invention

In the compound type heat exchanger of the present invention, the first heat exchanger is composed of the plurality of the divided bodies, the certain divided body being provided with the accommodation portion and the second heat exchanger being arranged in the accommodation portion. Therefore, the design freedom of the first heat exchanger and the second heat exchanger can be increased.

In addition, the certain divided body can employ common use parts, and only the design change of the other divided bodies can easily accommodate many kinds of the first exchangers different in the heights of their core parts.

Alternatively, only the design change of the certain divided body can easily accommodate many kinds of the second heat exchangers different in size.

DESCRIPTION OF REFERENCE NUMBERS

Figure 1:
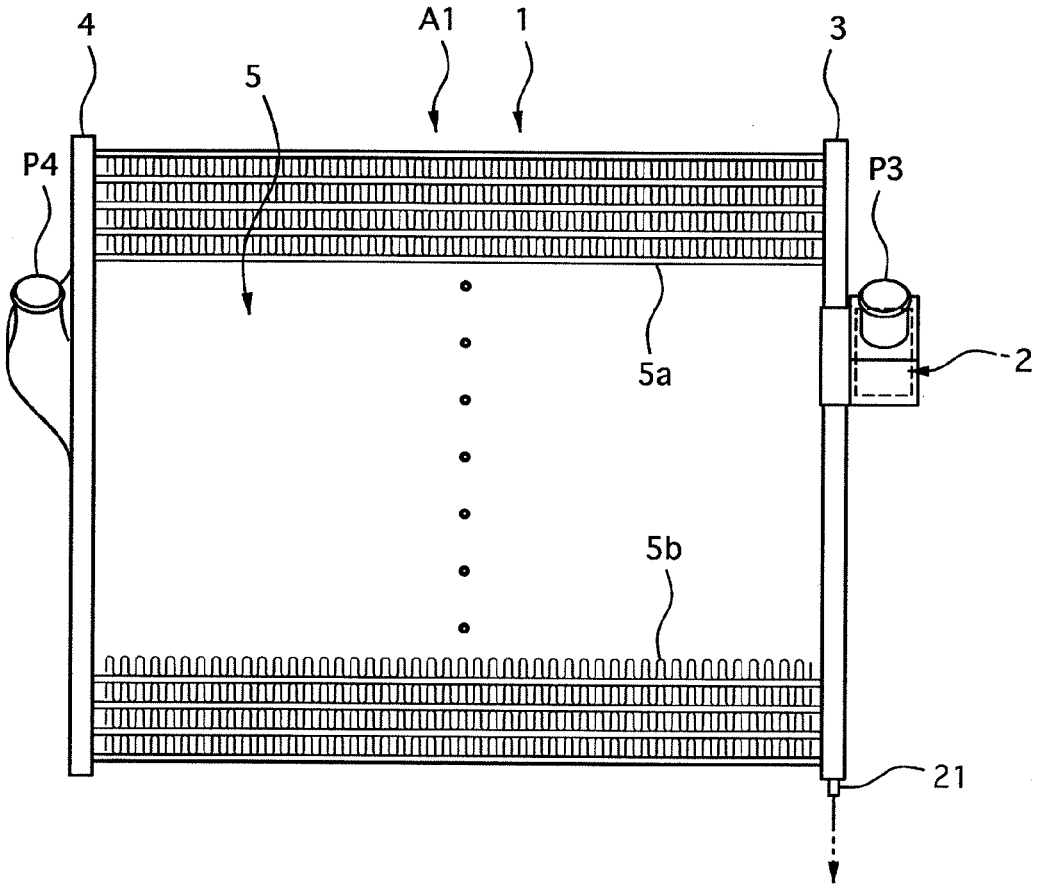
FIG. 1 is a front view showing a compound type heat exchanger of a first embodiment of the present invention.

A1 compound type heat exchanger
A2 engine
A3 radiator
A4 thermostat
A5 water pump
A6 turbocharger
A7 EGR cooler
a1, a2, a3, a4, a5, a6, a7, a8, a9, a10, a11, a12, a13 passage
B1, B2 bolt
O1 clearance
O2 opening portion
P1, P3 input port
P2, P4 output port
R1, R2, R3 chamber
S1, S2 seal member
1 first heat exchanger
2 second heat exchanger
3, 4, 13, 14 tank
5, 15 core part
5*a*, 5*c*, 15*a* tube
5*b*, 15*b* fin
6, 7, 8 divided body
6*a*, 7*a*, 8*a* tube hole
7*b* opening portion
9 accommodation portion
10 collection portion
10*a* passage
11 projecting portion
11*a* opening portion
11*b* bolt hole
16 partition wall
17 obstruction member
17*a* through-hole
18 base portion
18*a* through-hole
19 seat portion
19*a* opening portion
20, 21 discharge pipe
22 engine cooling circuit
23 turbocharger circuit
24 fan
30 insertion member
30*a* insertion portion
30*b* engagement portion
31 deformed portion

BEST MODE FOR CARRYING OUT THE INVENTION

Hereinafter, the embodiments of the present invention will be explained with reference to the accompanied drawings.

First Embodiment

Hereinafter, a first embodiment of the present invention will be described.

Incidentally, a vehicular front and rear direction and a vehicular width direction are respectively referred to as a front and rear direction and a left and right direction in the description below.

Figure 2:
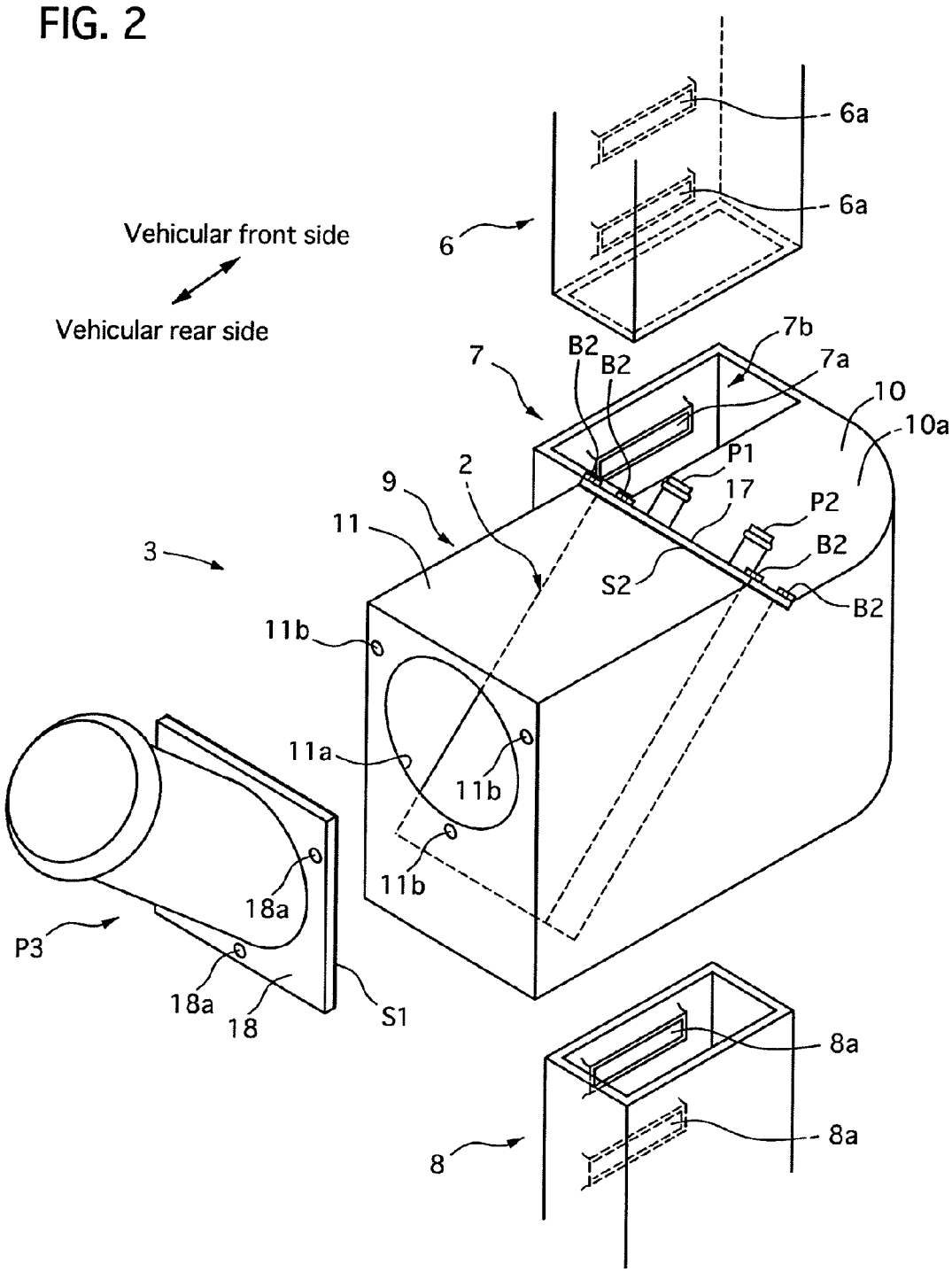
FIG. 2 is an exploded perspective view showing a relevant part of the compound type heat exchanger of the first embodiment.
Figure 3:
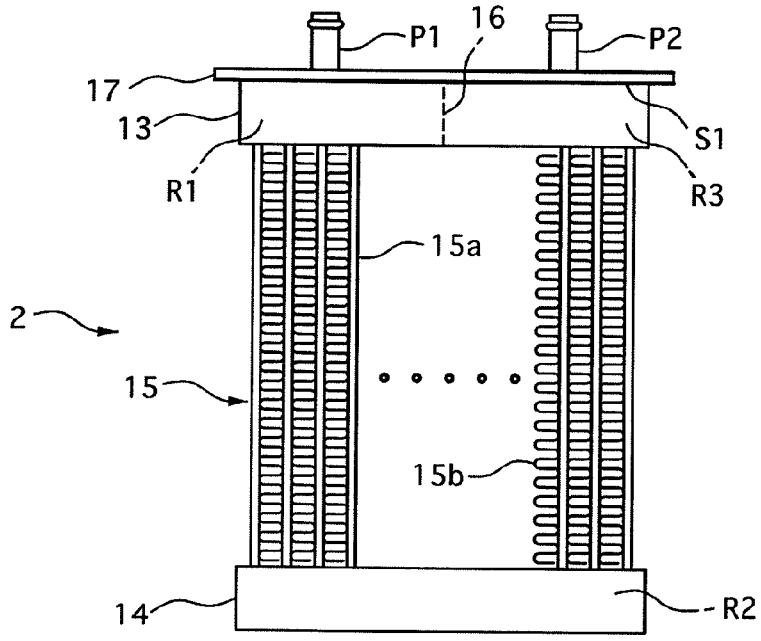
FIG. 3 is a front view of a second heat exchanger of the compound type heat exchanger of the first embodiment.
Figure 4:
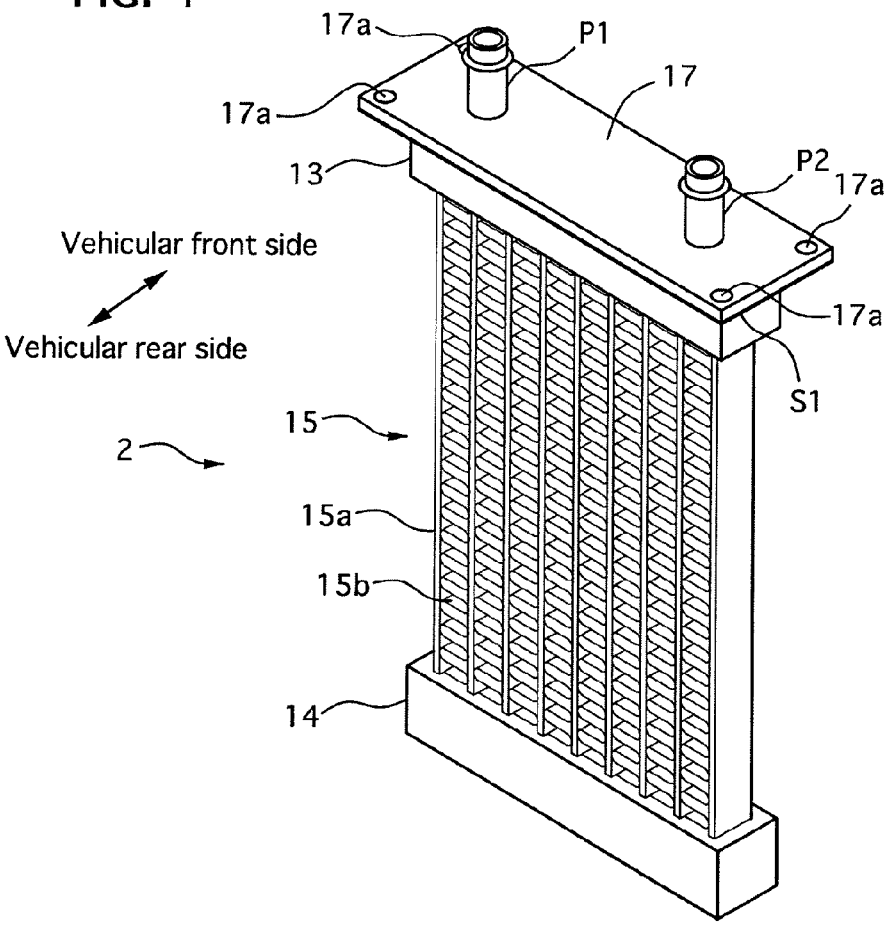
FIG. 4 is a perspective view of the second heat exchanger shown in FIG. 3.
Figure 5:
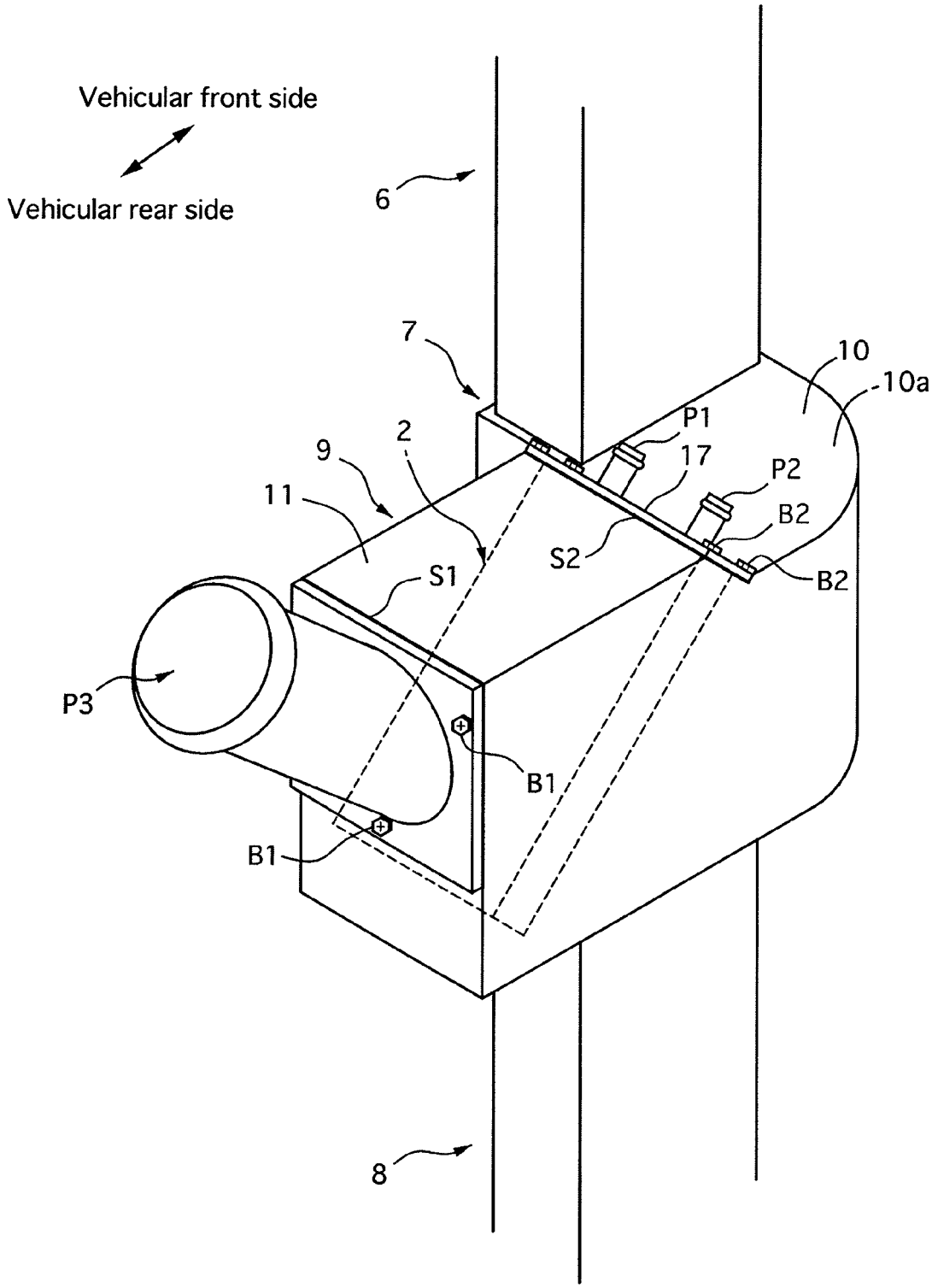
FIG. 5 is a perspective view showing a main part of a tank of the compound type heat exchanger of the first embodiment.

FIG. 1 is a front view showing a compound type heat exchanger of the first embodiment, FIG. 2 is an exploded perspective view showing a relevant part of the first embodiment, FIG. 3 is a front view showing a second heat exchanger of the first embodiment, FIG. 4 is a perspective view of the same, and FIG. 5 is a perspective view showing a main part of a tank of the first embodiment.

Figure 6:
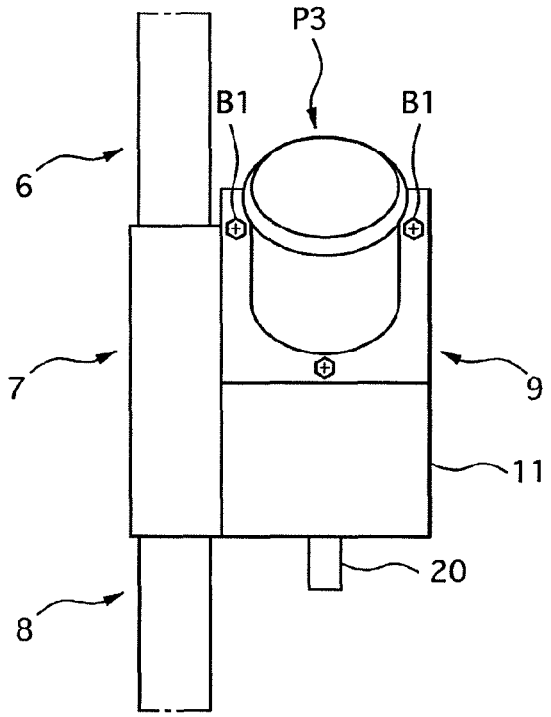
FIG. 6 is a front view showing the main part of the tank shown in FIG. 5.
Figure 7:
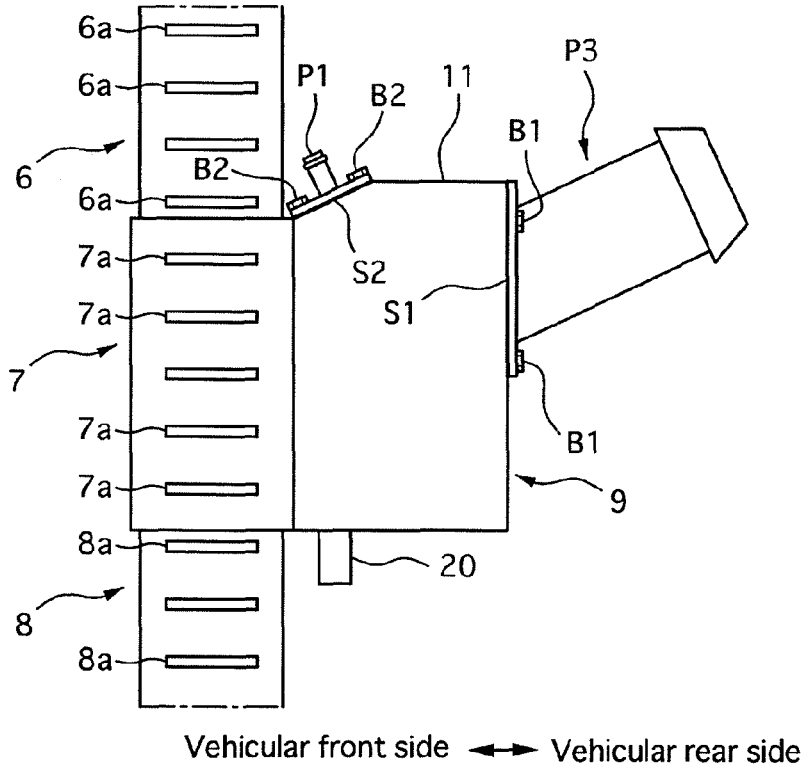
FIG. 7 is a left side view showing the main part of the tank shown in FIG. 5.
Figure 8:
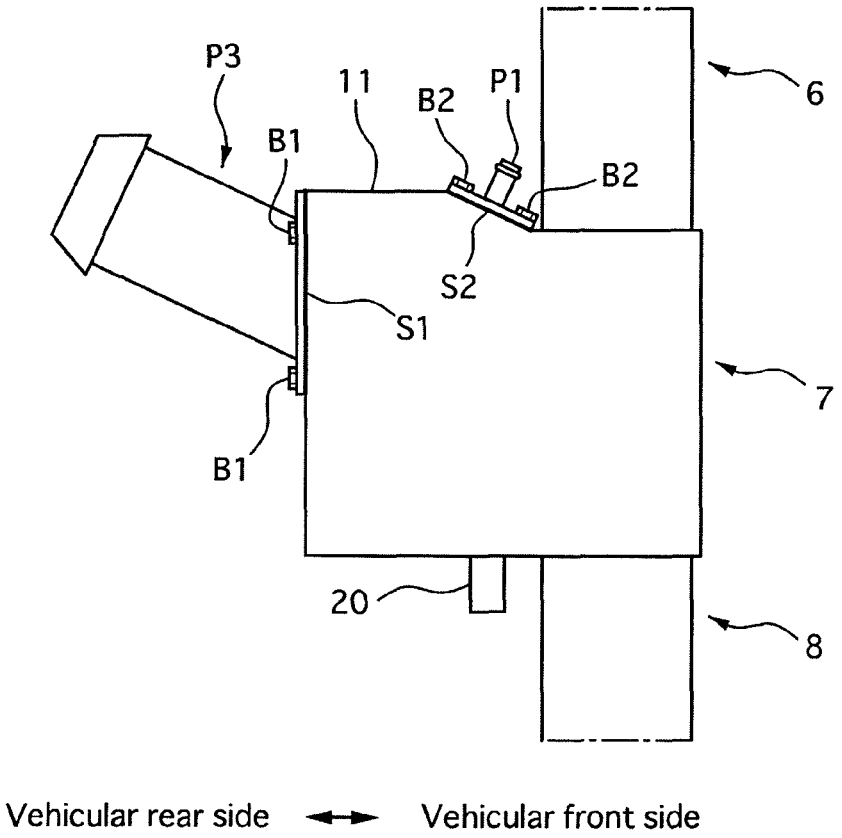
FIG. 8 is a right side view showing the main part of the tank shown in FIG. 5.
Figure 9:
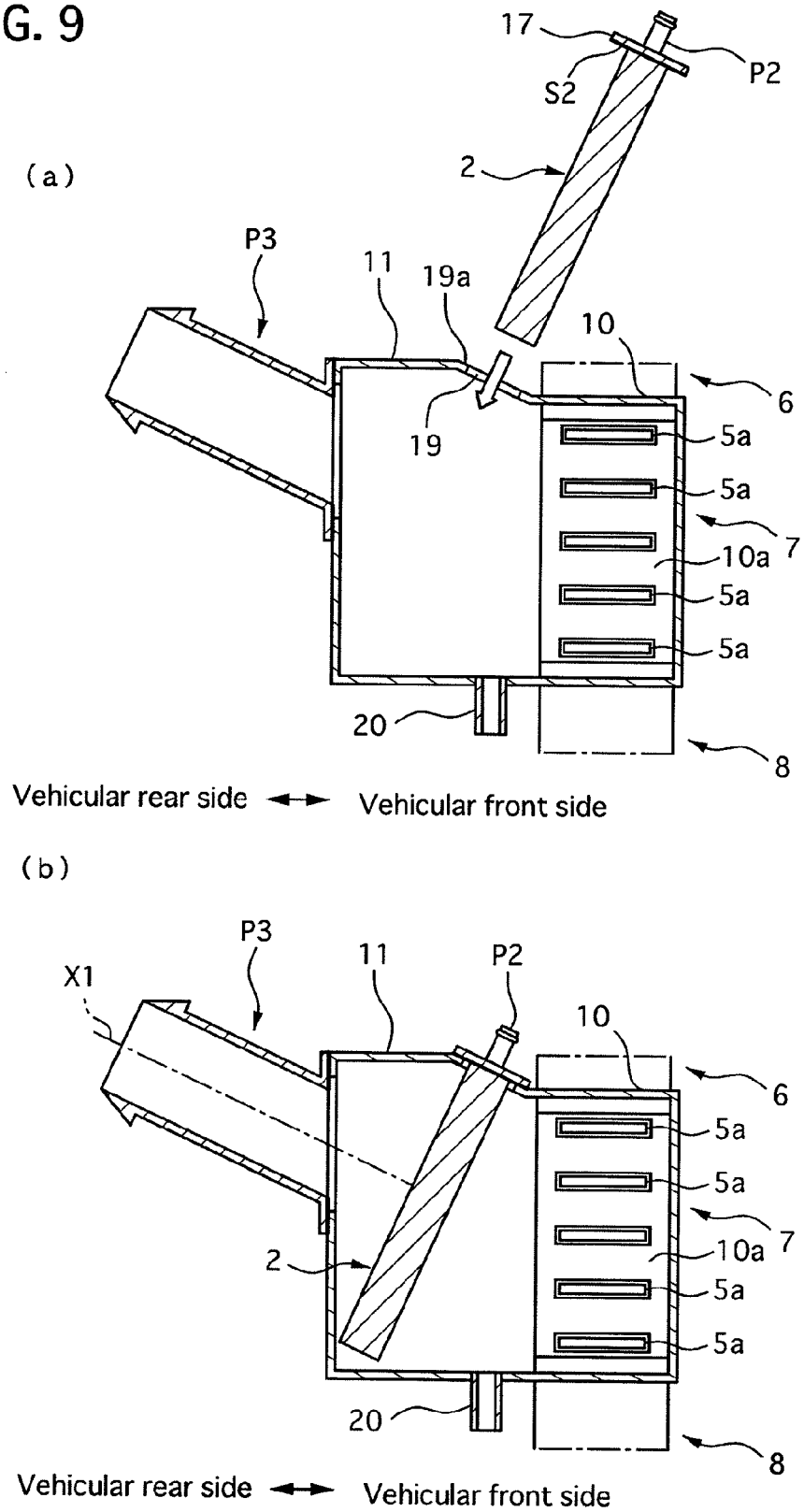
FIG. 9 is a view explaining how to fix the second heat exchanger in the compound type heat exchanger of the first embodiment.
Figure 10:
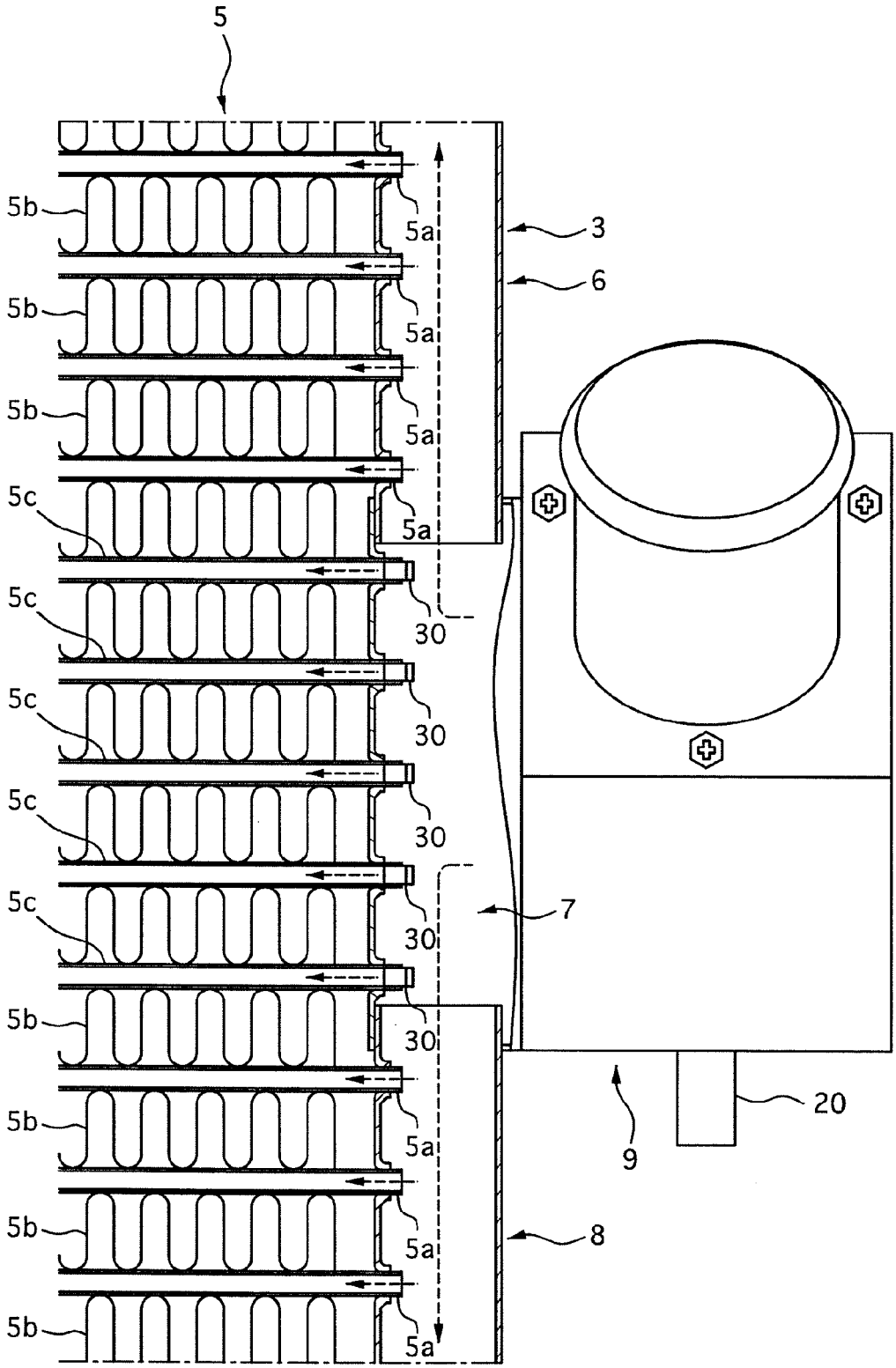
FIG. 10 is a view showing an interior of the tank shown in FIG. 5.
Figure 11:
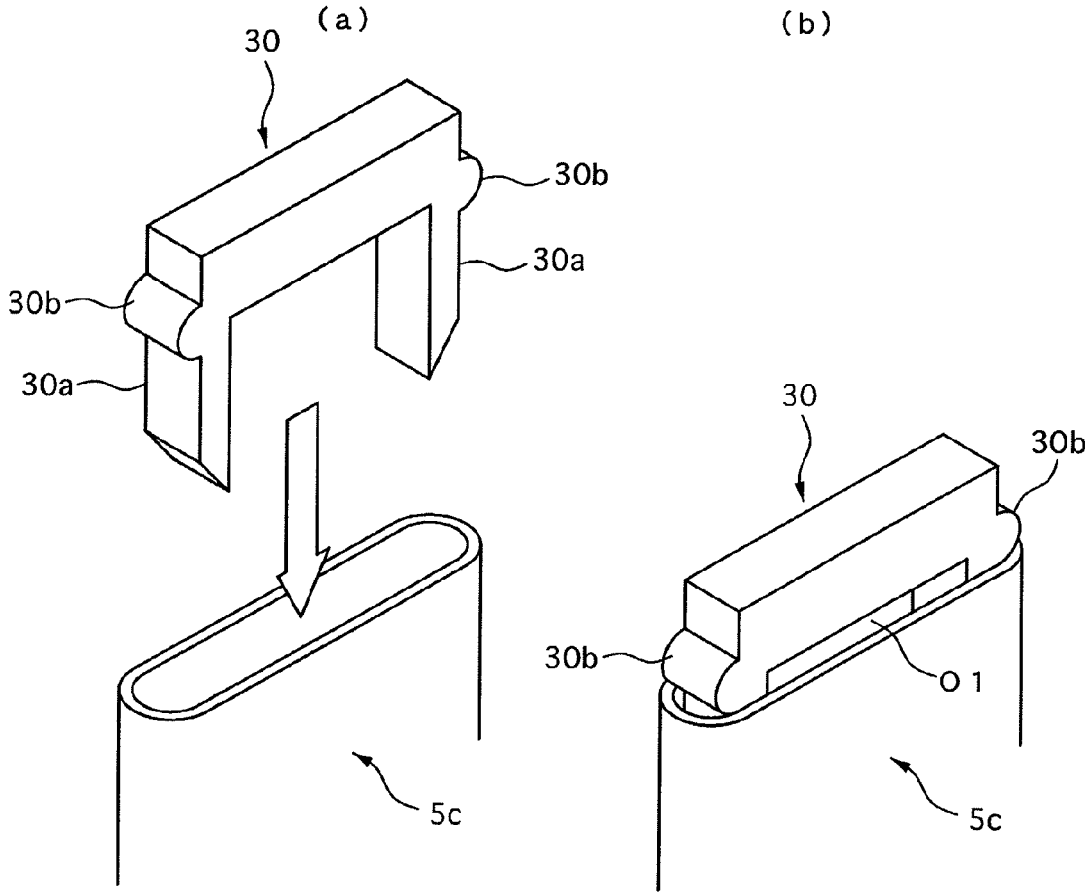
FIG. 11 is a view showing the states (a) before an insertion member is fixed to a tube and (b) after the insertion member is fixed to the tube in the compound type heat exchanger of the first embodiment.
Figure 12:
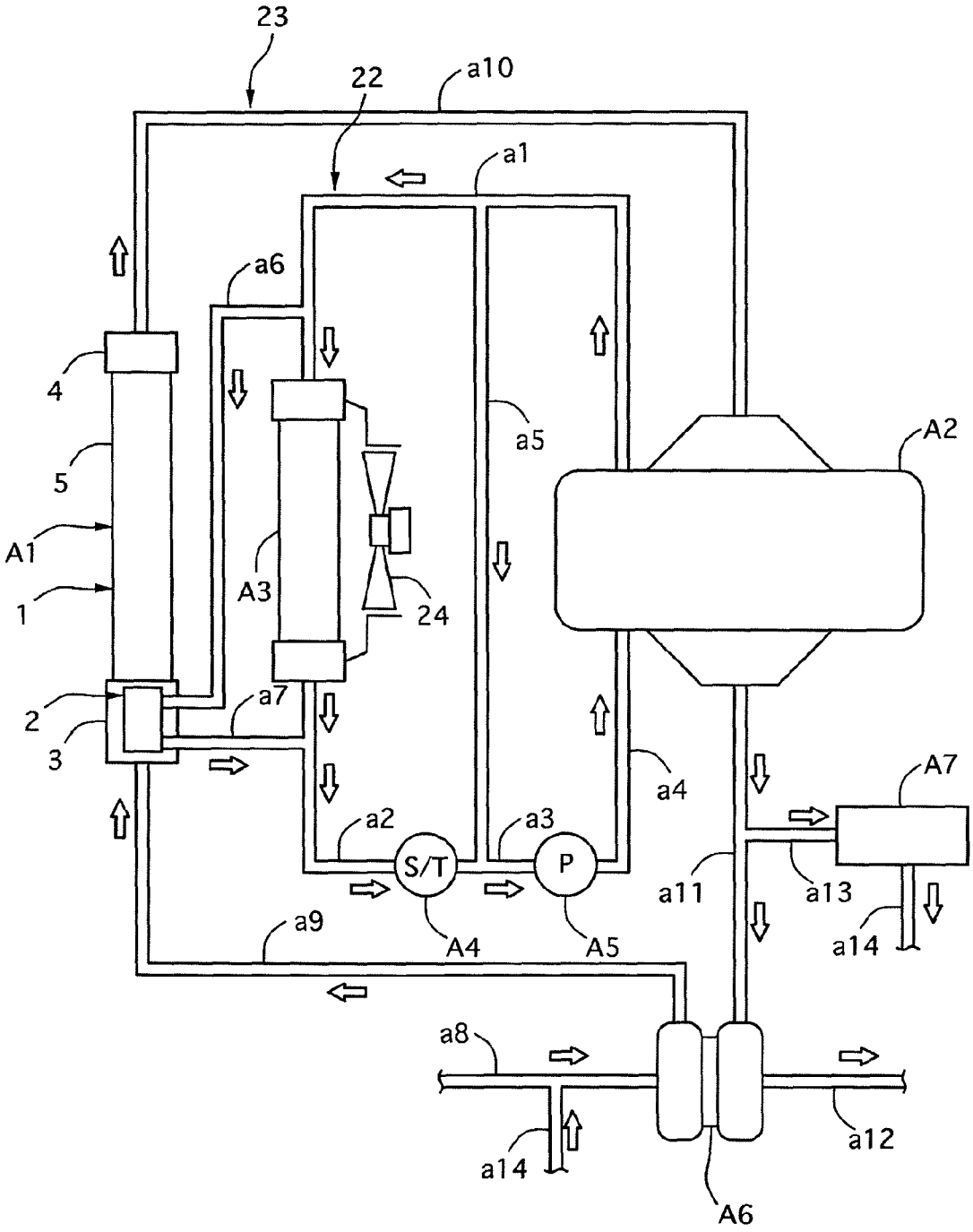
FIG. 12 is a view showing an engine cooling circuit and a turbocharger circuit that use the compound type heat exchanger of the first embodiment.
Figure 13:
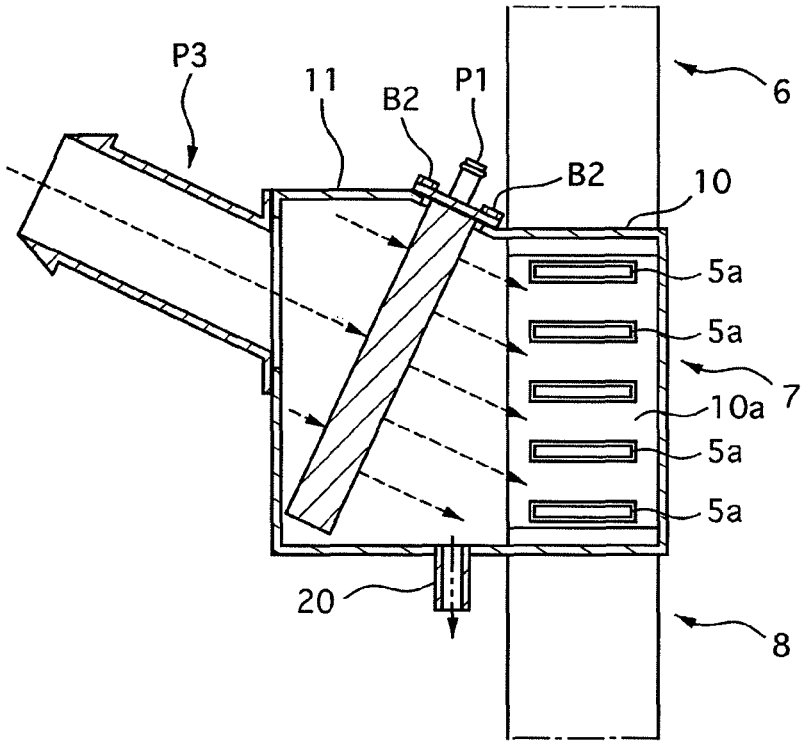
FIG. 13 is a view explaining the operation of the compound type heat exchanger of the first embodiment.

FIG. 6 is a front view showing a main part of the tank that is used in the compound type heat exchanger of the first embodiment, FIG. 7 is a left side view of the tank, FIG. 8 is a right side view of the tank, FIG. 9 is a view explaining how to fix the second heat exchanger that is used in the compound type heat exchanger of the first embodiment, FIG. 10 is view showing an interior of the tank, FIG. 11 is a view showing the states (a) before an insertion member is fixed to a tube and (b) after the insertion member is fixed to the tube in the compound type heat exchanger, FIG. 12 is a view showing an engine cooling circuit and a turbocharger circuit of the first embodiment, and FIG. 13 is a view explaining the operation of the compound type heat exchanger of the first embodiment.

First, the entire construction of the compound type heat exchanger of the first embodiment will be explained.

As shown in FIG. 1, the compound type heat exchanger A1 of the first embodiment is equipped with a first heat exchanger 1, a second heat exchanger 2 and others.

The first heat exchanger 1 is an intercooler that is incorporated in a turbocharger circuit 23, which will be later described, and the first heat exchanger 1 is provided with a pair of long tanks 3, 4 that are arranged a certain distance apart from each other in the right and left direction, and a core part 5 that is arranged between the both tanks 3, 4. The core part 5 to includes a plurality of flat tubes 5*a* inserted in and fixed to the both tanks 3, 4, and fins 5*b* that are arranged being stacked alternatively with the tubes 5*a* and are formed like a wave plate whose wave-like top portions are joined on the adjacent tubes 5*a*.

Incidentally, the fins 5*b* may be removed.

In addition, a pair of upper and lower reinforcements may be provided at the both sides of the core part 5 in its stack direction to be inserted in and fixed to the both tanks 3, 4.

Further, inner fins may be provided in the interiors of tubes 5*a*.

As shown in FIG. 2, the tank 3 is composed of three divided bodies 6 to 8 that are connected in a longitudinal direction.

The upper side divided body 6 is formed in a cylinder, having a rectangular cross section and a bottom portion, which opens toward the divided body 7, and the upper side divided body 6 is formed in its inner side with a plurality of tube holes 6*a* equally spaced so that the corresponding end portions of the tubes 5*a* can be inserted in and fixed to the tube holes 6*a* (refer to FIG. 7).

The lower divided body 8 is formed in a cylinder, having a rectangular cross section and a bottom portion, which opens toward the intermediate divided body 7, and the lower side divided body 8 is formed in its inner side with a plurality of tube holes 8*a* equally spaced so that the corresponding end portions of the tubes 5*a* can be inserted in and fixed to the tube holes 8*a* (refer to FIG. 7).

The intermediate divided body 7 is formed in its inner side with a plurality of tube holes 7*a* equally spaced so that the corresponding end portions of the tubes 5*a* can be inserted in and fixed to the tube holes 7*a* (Five holes are illustrated in the first embodiment as shown in FIG. 7).

Incidentally, each divided body 6 to 8 may be composed of a tube plate and a tank main body, where the tube plate is made of aluminum and shaped like a dish so that the tubes can be inserted in and fixed to the tube plate, and the tank main body is made of resin material and shaped like a serving dish, being fixed by caulking with the tube plate in a state they are coupled with each other like a box, as well as conventional tanks of intercoolers made of resin material.

In addition, at the upper and lower sides of the intermediate divided body 7, opening portions 7*b* (the lower opening portion is not illustrated) are formed to fit the outer profiles of the end portions of the divided bodies 6, 8, respectively.

In addition, at the outer side of the intermediate divided body 7, an accommodation portion 9 is formed to have a shape projecting a rear direction through a collection part 10 extending in the left and right direction.

In the collection portion 10, narrow passages 10*a* (refer to FIG. 9) are formed, and a projecting portion 11 is provided to have a rectangular shape, projecting rearward in a state where the projecting portion 11 communicates with the passages 10*a*.

At a rear surface of the projecting portion 11, a circular opening portion 11*a* and a plurality of bolt holes 11*b* (Three are illustrated in the first embodiment.) are formed.

Incidentally, the opening portion 11*a* is formed slightly larger in opening diameter than an input port P3, which will be described.

As shown by a dashed line in FIG. 2, the second heat exchanger 2 is arranged in an inclined state in the projecting portion 11.

As shown in FIG. 3 and FIG. 4, the second heat exchanger 2 is equipped with a pair of long tanks 13, 14 arranged a certain distance apart from each other in an upward and downward direction, and a core part 15 arranged between the both tanks 13, 14.

The core part 15 includes a plurality of flat tubes 15*a* inserted in and fixed to the both tanks 13, 14, and fins 15*b* that are arranged being stacked alternatively with the tubes 15*a* and are formed like a wave plate whose wave-like top portions are joined on the adjacent tubes 15*a*.

Incidentally, the fins 15*b* may be removed.

In addition, a pair of left and right reinforcements may be provided at the both sides of the core part 15 in its stack direction to be inserted in and fixed to the both tanks 13, 14.

In addition, a partition wall 16 separates the interior of the upper tank 13 into two chambers, a first chamber R1 and a third chamber R3. Further, an input port P1 is provided in a state where it communicates with the first chamber R1, while an output port P2 is provided in a state where it communicates with the third chamber R3.

Further, a second chamber R2 is provided in the interior of the lower tank 14.

In addition, the both ports P1, P2 are provided in a state where they pass through an obstruction member 17 shaped like a plate. As shown in FIG. 4, through-holes 17*a* are formed at four corners of the obstruction member 17, respectively.

As shown in FIG. 5 to FIG. 8, the end portions of the both divided bodies 6, 8 are respectively inserted into the opening portions 7*b* formed on the upper and lower surfaces of the intermediate divided body 7 to certain extents, and then they are connected to integrally join these three parts.

In addition, on the front surface of the projecting portion 11, the input port P1 is provided in a state where it faces to the opening portion 11, being fixed by bolts B1 being screwed into bolt holes 11*b* through through-holes 18*a* formed in its base portion 18 in a state where the base portion 18 of the input port P3 shown in FIG. 2 contacts with the front surface of the projecting portion 11.

Therefore, the input port P3 can be fixed on and detached from the accommodation portion 9 from its exterior side.

Incidentally, on the rear surface of the base portion 18 of the input port P3, a seal member S1 (illustrated by a heavy line in FIG. 5), which is made of heat-resistance material and shaped like a sheet, is affixed to ensure a sealing performance of the interior of the accommodation portion 9.

Further, as shown in FIG. 9, the second heat exchanger 2 is inserted along an oblique direction into the opening portion 19*a* of the slanted seat portion 19 formed on the upper surface of the projecting portion 11 to be in a state where the obstruction member 17 contacts with the seat portion 19. The second heat exchanger 2 is arranged in the projecting portion 11 in a diagonally suspended state, being fixed by bolts B2 being screwed into not-shown bolt holes of the seat portion 19 through the through-holes 17*a* of the obstruction member 17.

Therefore, the second heat exchanger 2 can be fixed to and detached from the accommodation portion 9 from the exterior side.

Incidentally, on the rear surface of the obstruction member 17 of the input port P3, a seal member S2 (illustrated by a heavy line), which is made of heat-resistance material and shaped like a sheet, is affixed to ensure a sealing performance of the interior of the accommodation portion 9.

In addition, the input port P3 and the core part 5 are arranged in such a way that the central axis X1 (illustrated in FIG. 9 (*b*)) of the input port P3 and the core part 5 of the second heat exchanger 2 are orthogonal to each other.

Incidentally, the input port P1 and the second heat exchanger 2 are diagonally arranged in the first embodiment, to which the present invention is not limited. In addition, the second heat exchanger 2 may be fixed on an inner wall of the projecting portion 11 by using not-shown brackets.

As shown in FIG. 6 to FIG. 9, a discharge pipe 20 extending below is provided on the bottom portion of the projecting portion 11 of the accommodation portion 9, in particular on the collection portion (10) side of the projecting portion 11, so as to communicate with the projecting portion 11 of the accommodation portion 9.

Further, as shown in FIG. 1, a discharge pipe 21 extending below is provided on the bottom portion of the divided body 8 so as to communicate with the intermediate divided body 7.

The tank 4 is formed as a hollow body shaped like a rectangle with a rectangular cross section, and the corresponding end portions of the tubes 5*a* are inserted in and fixed to the inner side of the tank 4.

In addition, as shown in FIG. 1, an output port P4 is provided on the outer side of the tank 4 to bent rearward and project in the oblique direction so as to communicate with the interior of the tank 4.

In addition, as shown in FIG. 10, insertion members 30 are inserted in and fixed to the end portions of the tubes 5*c* that are inserted in and fixed to the intermediate divided body 7 in the plurality of tubes 5*a*.

As shown in FIG. 11 (*a*), the insertion members 30 are entirely formed like a letter U, and engagement portions thereof 30*b* are respectively formed to project toward the outer side from the base portions of the insertion portions 30*a*, 30*a* facing to each other of the letter U.

Further, as shown in FIG. 11 (*b*), the insertion portions 30*a*, 30*a* of the insertion member 30 are inserted in the tubes 5*c* and each engagement portion 30*b* is engaged with the end portion of the tube 5*c*, so that the insertion members 30 are inserted in and fixed to the tubes 5*c*.

In addition, clearance O1 are formed between the end portions of the tubes 5*c* and the insertion members 30.

The entire construction members of the compound type heat exchanger A1 of the first embodiment are made of metal material such as aluminum. At least one side of the joined portion of each construction member includes a brazing sheet or a brazing material formed by coating or pasting flux in advance.

Then, after the entire construction members of the first heat exchanger 1 are temporally assembled in advance except the second heat exchanger 2 and the input port P3, it is heat-treated to join the connecting portion of each construction member by brazing to be integrally formed.

On the other hand, after the entire construction members of the second heat exchanger 1 are temporally assembled in advance, it is heat-treated to join the connecting portion of each construction member by brazing to be integrally formed.

Next, an engine cooling circuit 22 and a turbocharger circuit 23, which use the compound type heat exchanger A1 of the first embodiment, will be described.

As shown in FIG. 12, in the engine cooling circuit 22, an engine A2, a radiator A3, a thermostat A4 and a water pump A5 are connected to circulate coolant as a flowing medium through passages a1 to a4.

In addition, the passage a5 is provided to be arranged parallel to the radiator A3, thereby bypassing it.

Further, the passage a6 branching from the passage a1 is connected with the input port P1 of the second heat exchanger 2 of the compound type heat exchanger A1, while the passage a7 branching from the passage a2 is connected with the output port P2 of the second heat exchanger P2.

The turbocharger circuit 23, using the air as a flowing medium, is equipped with the compound type heat exchanger A1, the engine A2, a turbocharger A6, an EGR cooler A7 and so on.

The upstream side of the compressor of the turbocharger A6 is connected with the passage a8, and the downstream side thereof is connected with the input port P3 of the first heat exchanger 1 of the compound type heat exchanger A1 through a passage a9.

The output port P4 of the compound type heat exchanger A1 is connected with not-shown intake ports of the engine A2 through a passage a10 (an intake manifold).

In addition, not-shown exhaust ports of the engine A2 is connected with the upstream side of the turbine of the turbocharger A6 through a passage a11 (an exhaust manifold).

Further, the downstream side of the turbine of the turbocharger A6 is connected with a passage a12.

Further, the upstream side of the EGR cooler A7 is connected with the passage a11 through a passage a13, while the downstream side thereof is connected with a passage a7 through a passage a14.

Further, not-shown check valves are provided at appropriate positions in the passage a5 and other passages.

Next, the operation of the compound type heat exchanger of the first embodiment, the engine cooling circuit 22 and the turbocharger circuit 23 will be described.

<As to the Operation of the Engine Cooling Circuit and the Turbocharger Circuit that Use the Compound Type Heat Exchanger>

In the thus-constructed compound type heat exchanger A1, as shown in FIG. 12, in a case where the temperature of the coolant is equal to or lower than a certain temperature before the engine A2 is warmed up (when the temperature of the coolant is low), the thermostat A4 closes the passage a2 in the engine cooling circuit 22, so that the coolant discharged from the engine A2 flows to the passage a1→the passage a5→the passage a3→the water pump A5→the passage a4 in these order, and it returns to the engine A2.

When the temperature of the coolant exceeds the certain temperature after the engine A2 is warmed up (when the temperature of the coolant is high), the thermostat A4 opens the passage a2, so that the coolant discharged from the engine A2 flows to the passage a1→the radiator A3→the passage a2→the thermostat A4→the passage a3→the water pump A5→the passage a4 in these order, and it returns to the engine A2. In this operation, the coolant at high temperature of approximately 80° C. (in a case of large vehicles) is cooled down to approximately 60° C. (in a case of the large vehicles) due to heat exchange with the airflow generated when the vehicle runs or the airflow generated by a fan 24 while it passes through the radiator A3. Thus the engine A2 can be cooled.

In addition, a part of the coolant in the passage a1, first, flows in the input port P1 of the second heat exchanger 2 through the passage a6. Subsequently, the coolant that flows in the input port P1 of the second heat exchanger 2 flows in the first chamber R1 of the tank 13, and then it flows to the chamber R2 of the tank 14 and the chamber R3 of the tank 13 in this order through the corresponding tubes 15*a*, then being discharged to the passage a7 through the outlet port P2.

In the turbocharger circuit 23, the intake air that is sucked into the passage a8 through a not-shown air duct and a not-shown filter is changed to have a high-temperature and pressure state by the compressor of the turbocharger A6, and then it flows in the input port P3 of the first heat exchanger 1 through the passage a9.

Subsequently, the intake air at high temperature of approximately 170° C. (in a case of the large vehicles) flowing in the input port P3 of the first heat exchanger 1 flows in the accommodation portion 9 to be cooled down due to the heat exchange with the coolant flowing in the tubes 15*a* while it passes through the core part 15 of the second heat exchanger 2, then flowing in the tank 3 through the collection portion 10.

Then, the intake air that flows in the tank 3 is cooled down to approximately 40° C. (in a case of the large vehicles) due to the heat exchange with the airflow generated when the vehicle runs or the airflow generated by the fan 24 while it flows in the tank 4 through the tubes 5*a*.

The intake air that flows in the tank 4 is discharged to the passage 10 (the intake manifold) through the output port P4, and then it flows in the intake ports of the engine A2. Therefore, the turbo-charge efficiency of the engine A2 increases to improve the output power of the engine.

The intake air introduced in the engine A2 changes to the exhaust gas and passes through the passage a11 to drive the turbine of the turbocharger A6, and then it is discharged to the exterior through the passage a12 (the exhaust manifold) and an exhaust system such as a not-shown a catalyst for purifying the exhaust gas and a muffler.

In addition, a part of the exhaust gas in the passage a11 (the exhaust manifold) flows in the EGR cooler A7 through the passage a13, and it is cooled down due to the heat exchange with a flowing medium in a not-shown sub-radiator. Then, the exhaust gas returns to the passage a8 through the passage a14.

Thus, in the first embodiment, the high-temperature heat can be removed by introducing the part of the coolant of the engine A2 to the second heat exchanger 2 and cooling the intake air of the first heat exchanger 1 before it flows in the core part 5.

Therefore, heat shock to each portion, due to extreme lowering of temperature of the intake air, can be avoided by the intake air being cooled down in stages by the first heat exchanger 1. In addition, effective cooling by aid to cool the core part 5 can be performed.

In addition, the part of the exhaust gas is cooled down by the EGR cooler A7, and then it returns to the passage a8. Therefore, the exhaust gas can be purified by introducing the unburned components contained in the exhaust gas into the engine A2 again.

Further, in the first embodiment, since the exhaust gas discharged from the EGR cooler A7 is returned to the passage a8 at the upstream side of the compressor 36*a* of the turbocharger A6, the EGR ratio can be set higher relative to a case where it is returned to the passage a10 (the intake manifold).

<As to Cooling of the Intake Air by the Second Heat Exchanger>

In the first embodiment, as described above, the input port P3 and the core part 15 are arranged in such a way that the central line X1 of the input port P3 and the core part 15 of the second heat exchanger 2 are orthogonal to each other.

Therefore, it becomes easier for the intake air (indicated by broken arrows) flown in the projecting portion 11 through the input port P3 to pass through the core part 15 of the second heat exchanger 2, and thereby the hot air can be prevented from accumulating in a space at the input port (3) side of the second heat exchanger 2. Thus the intake air can be smoothly cooled.

<As to the Temperature Homogenization of the Intake Air>

Herein, there is a possibility of the deterioration of the root portions and others of the tubes because heat stress occurs due to the uneven temperature distribution of the core part in a case where the temperature of the intake air flowing in the tubes of the first heat exchanger are different from each other in tubes.

Therefore, in the prior invention, the core part of the second heat exchanger needs to be arranged in a state where it is arranged near and faces to all the tubes as the second heat exchanger is arranged in the tank of the first heat exchanger. This causes the second heat exchanger to be unnecessarily larger in size.

Compared with this, in the compound type heat exchanger of the first embodiment, the second heat exchanger 2 is placed in the accommodation portion 9 of the divided body 7, and accordingly the intake air can flow in all the tubes 5*a* after the temperature of the intake air passing through the second heat exchanger 2 becomes uniform in the accommodation portion 9. Therefore, the second heat exchanger 2 can be downsized to a large extent, without generating the heat stress due to the uneven temperature distribution of the core part 5.

On the other hand, in the prior invention, the uneven temperature distribution occurs in the flowing medium of the first heat exchanger after it exchanges heat when passing through the second heat exchanger, and consequently the heat stress occurs due to the uneven temperature distribution of the core part. Accordingly, there is a possibility of deterioration in the durability of the core part of the first heat exchanger.

Compared with this, in the compound type heat exchanger of the first embodiment, the accommodation portion 9 is provided to project outwardly from the tank 3 though the collection portion 10 having narrow (opening-space reduced) passages 10*a*, and the second heat exchanger 2 is arranged in the accommodation portion 9.

Therefore, the intake air that passes through the second heat exchanger 2 can be mixed up in the narrow passages 10*a* of the collection portion 10 and the accommodation portion 10 to have uniform temperature and then to flow in the tank 3.

Accordingly, the intake air can flow through each tube 5*a* at the same temperature, and thereby the generation of the heat stress due to the even temperature distribution of the core part 5 can be avoided.

<As to the Flow Amount of the Flowing Medium that Flows to Each Tube of the First Heat Exchanger>

In the first embodiment, as explained with reference to FIGS. 10 and 11, the insertion members 30 are inserted in and fixed to the end portions of the divided body 7.

In addition, the clearances O1 are formed between the end portions of the tubes 5 and the insertion members 30.

Therefore, as shown in FIG. 10, most of the intake air (indicated by broken arrows in FIG. 10) that flows in the divided body 7 from the accommodation portion 9 through the collection portion 10 can flow along the longitudinal direction of the tank 3 and flow in each tube 5*a*.

In addition, a part of the intake air (indicated by broken arrows in FIG. 10) that flows in the tank 3 can flow in the tubes 5*a* through the clearances O1.

Accordingly, the insertion members 30 can regulate the flow amount of the intake air in the tubes 5*c* of the intermediate divided body 7 where they are arranged near the inlet toward the tank 3 of the intake air and a large amount of the intake air could easily and swiftly flow therein.

In other words, in the first embodiment, the clearances O1 are set so that the flow amount of the intake air that flow in the tubes 5*c* can be equal to or less than that in the other tubes 5*a*.

Thus, in the first embodiment, the flow amount of the intake air in each tube 5*a* can be uniform, and thereby the temperature distribution can be uniform.

Incidentally, the insertion members 30 may be provided at the tank (4) side end portions of the tubes 5*c*.

In addition, the insertion members 30 are attached to all of the tubes 5*c* in the first embodiment, to which the present invention is not limited. The number of the tubes 5*c* and the insertion members 30 may be set appropriately.

Further, in some cases, a so-called dead tube, which completely blocks communication of the flowing medium of the tubes 5*c*, may be employed.

<As to Heat Expansion and Construction of the Second Heat Exchanger>

The coolant that flows through the second heat exchanger 2 is the coolant of the engine A2, and accordingly its temperature changes between an outside temperature and approximately 80° C.

Consequently, the second heat exchanger 2 expands and contracts due to the heat, and accordingly there is a possibility that the adverse affect of heat stress due to heat expansion and construction may occur in a case where the second heat exchanger 2 is fixed on a wall portion in the projecting portion 11 by using brackets or others.

Compared with this, in the first embodiment, the second heat exchanger 2 is arranged in the projecting portion 11 in the obliquely suspended state, and the gap is formed between the second heat exchanger 2 and the wall portion in the projecting portion 11. Therefore, the second heat exchanger 2 can be fixed without unnecessary restraint, and thereby the adverse affect of the heat stress can be avoided by mainly expanding and contracting the tubes 15 in the longitudinal direction due to the heat.

<As to Condensed Water>

In the first embodiment, the exhaust gas that is discharged from the EGR cooler A7 is returned to the passage a8 at the upstream side of the compressor 36*a* of the turbocharger A6. Accordingly, the EGR ratio can be increased, but the water existed in the exhaust gas is contained in the intake air that is introduced to the first heat exchanger 1.

The water is acid, which might have the adverse affect on each portion of the first heat exchanger 1 and the second heat exchanger 2.

Compared with this, in the first embodiment, as shown in FIG. 13, the water contained in the intake air and the water (indicated by an alternate long and two short dashed arrow in FIG. 13) generated due to the intake air that is cooled in the second heat exchanger 2 are discharged below through the discharge pipe 20 from the bottom portion of the accommodation portion 9.

Therefore, the condensed water can be discharged at an earlier stage where the intake air flows in the first heat exchanger 1, and thereby the adverse affect on the first heat exchanger 1 and the second heat exchanger 2 due to the condensed water can be avoided.

Incidentally, the opening end portion of the divided body 8 of the first embodiment is connected with the bottom portion of the divided body 7 in a state where the opening end portion of the divided body 8 is inserted in the bottom portion of the divided body 7, and accordingly there is no possibility that the condensed water may accumulate on the bottom portion of the accommodation portion 9 and leak toward the divided body (8) side.

Further, as shown in FIG. 1, the discharge pipe 21 extended below is provided on the bottom portion of the divided body 8 to communicate with the divided body 7, and therefore the condensed water (indicated by an alternate long and two short dashed arrow in FIG. 1) accumulating in the tank 3 can be discharged toward the exterior thereof through the discharge pipe 21.

Incidentally, not-shown hoses, which extend down to the under floor of the vehicle, are attached to the lower end portions of the discharge pipes 20, 21. Incidentally, the diameters of the discharge pipes 20, 21 are small, while the discharge pipes 20, 21 may be provided with valves.

<As to Design Freedom of the First Heat Exchanger and the Second Heat Exchanger>

In the first embodiment, the tank 3 is composed of the plurality of divided bodies 6 to 8 that are connected along the longitudinal direction of the tank 3, and the accommodation portion 9 is provided in the divided body 7. The second heat exchanger 2 is arranged in the accommodation portion 9, on which the input port P3 is provided.

Therefore, the divided body 7 provided with the accommodation portion 9 can employ common use parts, and in this case, only the design change of the other divided bodies 6, 8 can easily accommodate many kinds of the first exchangers different in the heights of their core parts. Alternatively, only the design change of the divided body 7 with the accommodation portion 9 can accommodate many kinds of the second heat exchangers 2 with different sizes.

In addition, the input port P3 is fixed to the accommodation portion 9 detachably therefrom from the exterior side thereof, and therefore the input port P3 can be easily changed in an angle, a diameter, a configuration of its end portion, and others.

Incidentally, the opening portion 11*a* of the projecting portion 11 of the first embodiment is formed to be larger to some extent than the bore diameter of the input port P3, and the opening portion 11*a* is contacted and connected with the base portion of the inlet port P3 to communicate with each other in a state where they face to each other. Therefore, only the design change of the input port P3 can perform the design change of reducing or increasing in size of its bore diameter.

Thus, in the first embodiment, the design freedom of the first heat exchanger 1 and the second heat exchanger 2 can be increased.

<As to Downsizing of the First Heat Exchanger>

In the prior invention, since there is a need to accommodate the entire second heat exchanger in the tank of the first heat exchanger, a large space is needed inside the tank, and consequently the size of a core part of the first heat exchanger is limited.

Therefore, there is much loss because of the downsizing of the core part of the first heat exchanger.

Compared with this, in the first embodiment, the second heat exchanger is arranged in the accommodation portion 9, and therefore the design freedom of especially the size in a width direction of the tank 3 can be increased without the need of a large space in the tank 3.

In addition, the accommodation portion 9 has the shape projecting from the tank 3 in the width direction through the collection 10, and therefore the design freedom of the layout for arranging its peripheral members can be increased by reducing the height of the tank 3.

<As to a Maintenance Performance of the Second Heat Exchanger>

The second heat exchanger 2 is fixed to the accommodation portion 9 detachably therefrom from its exterior side.

Therefore, when the second heat exchanger 2 is replaced, repaired, checked and so on, the second heat exchanger 2 can be easily brought out of the accommodation portion 9 by removing the bolts B2. Accordingly, it provides an excellent maintenance performance.

The effects of the composite type heat exchanger A1 of the first embodiment will be described below.

(1) The first heat exchanger 1 is equipped with the pair of long tanks 3, 4 that are arranged the certain distance apart from each other and the core part 5 including the tubes 5*a* and the fins 5*b* that are alternately piled up between the both tanks 3, 4. The tank 3 is composed of the plurality of the divided bodies 6 to 8 that are connected along the longitudinal direction of the tank 3. The divided body 7 is provided with the accommodation portion 9 having the shape projecting outwardly to communicate with the certain divided body 7. The second heat exchanger 2 is arranged inside the accommodation portion 9, and the input port P3 is provided on the accommodation portion 9. The heat is exchanged between the intake air of the first heat exchanger 1 that flows in the accommodation portion 9 and the coolant of the second heat exchanger.

Therefore, the design freedom of the first heat exchanger 1 and the second heat exchanger 2 can be increased.

For example, the intermediate divided body 7 provided with the accommodation portion 9 can employ common use parts, and only the design change of the other divided bodies 6, 8 can accommodate many kinds of first heat exchangers 1 with different heights of the core parts 5. Alternatively, only the design change of the intermediate divided body with the accommodation portion 9 can accommodate many kinds of the second heat exchangers with different sizes.

(2) The input port P3 is fixed to the accommodation portion 9 detachably therefrom from its exterior side.

Therefore, it can accommodate input ports P3 with various angles, diameters and others.

(3) The second heat exchanger 2 is fixed to the accommodation portion 9 detachably therefrom from its exterior side.

Therefore, the maintenance performance of the second heat exchanger 2 can be improved.

(4) The second heat exchanger 2 is equipped with the pair of long tanks 13, 14 that are arranged the certain distance apart from each other and the core part 15 including the tubes 15*a* and the fins 15*b* that are alternately piled up between the both tanks 13, 14. The central line of the connection port and the core part 15 are arranged in such a way that they are orthogonal to each other.

Therefore, the heat exchange between the first exchanger 1 and the second heat exchanger 2 can be effectively performed.

(5) The accommodation portion 9 is provided to have the shape projecting in the width direction of the certain divided body 7.

Therefore, the tanks 3, 4 can be prevented in growing in the sizes in the left and right direction thereof, and thereby the design freedom of the layout for arranging its peripheral parts can be increased.

(6) The input port P3 is the inlet port for the intake air of the first heat exchanger 1, and the intake air of the first heat exchanger 1 is cooled down due to the heat exchange between the intake air in the first exchanger 1 and the coolant in the second heat exchanger 2.

Therefore, the intake air in the first exchanger 1 can be cooled in stages, the heat shock due to sudden fall of the temperature of the intake air can be prevented from occurring, and the coolability of the first heat exchanger 1 can be improved.

(7) The accommodation portion 9 is formed at the certain divided body (7) side of the second heat exchanger 2 with the collection portion 10 forming the narrow passages 10*a*. Accordingly, the intake air can flow in the tubes 5*a* of the core part 5 after the intake of the first heat exchanger 1 that exchanges its heat with the second heat exchanger 2 is uniformed in temperature by being mixed up in the collection portion 10.

Therefore, the heat stress due to the uneven heat distribution of the core part 5 can be prevented from occurring, so that a crack in the tubes 5*a*, 15*a* or a crack at tube holes 6*a*, 7*a*, 8*a* due to the heat shock can be avoided, and thereby the durability of the core part 5 and the durability of the first heat exchanger can be improved.

(8) The first heat exchanger 1 is the intercooler, and the flowing medium of the second heat exchanger is the coolant of the engine cooling circuit 22.

Therefore, it is preferable to apply the first heat exchanger 1 to the intercooler whose demand for cooling specification of recent high powered engines becomes higher.

In addition, a combination of the optimum thermal relationships between flowing mediums as heat exchange mediums can be realized.

(9) The discharge pipe 20 capable of discharging the condensed water is provided on the bottom portion of the accommodation portion 9. Therefore, the adverse affect on the first heat exchanger 1 and the second heat exchanger 2 due to the condensed water can be avoided.

(10) The discharge pipe 21 capable of discharging the condensed water is provided on the bottom portion of the tank 3.

Therefore, the adverse affect on the first heat exchanger 1 and the second heat exchanger 2 due to the condensed water can be suppressed to the minimum extent.

Second Embodiment

Hereinafter, a second embodiment of the present invention will be described.

Incidentally, in a compound type heat exchanger of the second embodiments, the construction members similar to those of the first embodiment are indicated by the same reference numbers and those descriptions are omitted. Only the differences will be in detail described.

Figure 14:
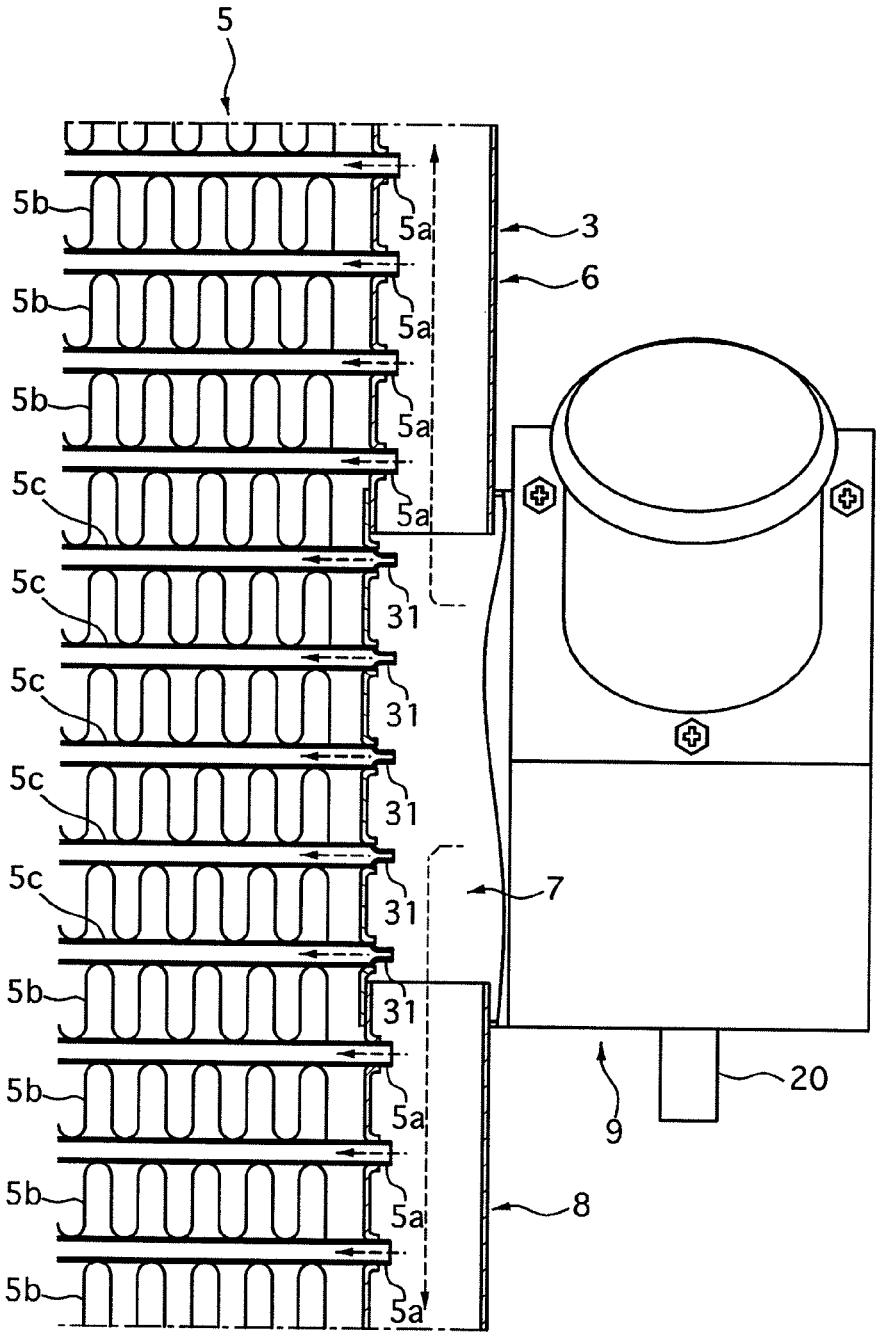
FIG. 14 is a view showing an interior of a tank that is used in a compound type heat exchanger of a second embodiment of the present invention.
Figure 15:
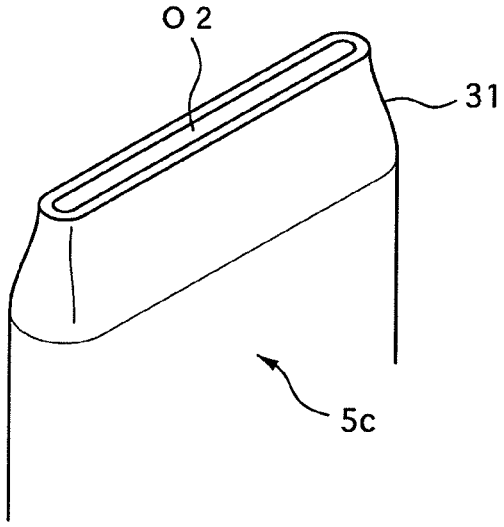
FIG. 15 is a perspective view showing a deformed portion of a tube that is used in the compound type heat exchanger of the second embodiment.

As shown in FIGS. 14 and 15, in the compound type heat exchanger, a deformed portion 31, where an end portion of a tube 5*c* is decreased in opening space, is employed instead of the insertion member 30 that has explained in the compound type heat exchanger of the first embodiment.

In addition, the end portion of the deformed portion 31 is formed with an opening portion O2 instead of the clearance O1 that has been explained in the first embodiment.

Therefore, in the second embodiment, the flow amount of the intake air flowing in the tubes 5*c* of a divided body 7 can be prevented from becoming larger than that in the other tubes 5*a*, and the operation and effects similar to those of the first embodiment can be obtained.

In addition, the deformed portion 31 can be formed by a simple work where the end portion of the tube 5*c* is deformed by a jig or the like to decrease its diameter opening space, without increasing the number of parts.

Incidentally, in some cases, a so-called dead tube, where the deformed portion 31 is completely caved to remove the opening portion O2, may be employed.

The compound type heat exchanger of the second embodiment has the following effects in addition to those effects.

(12) A flow adjustment means is formed by the deformed portions 31 where the end portions of the tubes 5*c* corresponding to the divided body 7 to decrease its opening space.

Therefore, it can easily obtain the effect similar to those of the first embodiment without using another member.

Although the embodiments have been described, the present invention is not limited to the above-described embodiments, and a design change and the like may be resorted to without departing from the scope of the present invention.

For example, the first heat exchanger 1 may be a radiator, the second heat exchanger 2 may be an oil cooler, and thus the present invention may be applied to a so-called radiator with a built-in oil cooler.

In this case, similarly to the radiator described in known Japanese Patent Application Laid-Open Publication No. 2008-32242, the input port P3 is an outlet port of the flowing medium of the first heat exchanger (the radiator), and the flowing medium of the second heat exchanger (the oil cooler) is cooled due to heat exchange between the flowing medium (the coolant) of the first heat exchanger (the radiator) and the flowing medium (the oil) of the second heat exchanger (the oil cooler).

In addition, material of each construction member may be selected appropriately, and its fixing method may be changed according to the selected material.

Further, the number of the divided bodies of the tank 3, these connecting structure and others may be set appropriately.

For example, the divided bodies may be connected with each other by using bolts.

Further, a portion of the tank 3 may be made of resin material.

Further, in the embodiments, the accommodation portion 9, which projects rearward through the collection portion 10 extending in the left and right direction from the divided body 7, is employed, and the direction of the displacement of the collection portion 10 and the accommodation portion 9 may be set appropriately.

The invention claimed is:

1. A compound type heat exchanger comprising:

a first heat exchanger having a pair of tanks arranged a certain distance apart from each other and a core part having a plurality of tubes between the pair of tanks: and a second heat exchanger, wherein at least one of the pair of tanks includes a plurality of divided bodies that is divided and connected along a longitudinal direction of the at least one of the pair of tanks, one of the plurality of divided bodies is provided with an accommodation portion that has an opening portion and projects outwardly to be connected with the one of the plurality of divided bodies so that a flowing medium of the first heat exchanger can flow to the one of the plurality of divided bodies, wherein the second heat exchanger is arranged in the accommodation portion, the accommodation portion is provided with a connection port as a gateway of the flowing medium of the first heat exchanger, heat is exchanged between the flowing medium of the first heat exchanger that flows through the accommodation portion and a flowing medium of the second heat exchanger, and the second heat exchanger is positioned through the opening portion and detachably fixed to the accommodation portion from an exterior side of the accommodation portion.

2. The compound type heat exchanger according to claim 1, wherein the connection port is detachably fixed to the accommodation portion from an exterior side of the accommodation portion.

3. The compound type heat exchanger according to claim 1, wherein the second heat exchanger is equipped with a pair of tanks arranged a certain distance apart from each other and a core part having a plurality of tubes between the pair of tanks, and the connection port and the core part are arranged in such a way that a central line of the connection port and the plurality of tubes of the core part of the second heat exchanger are orthogonal to each other.

4. The compound type heat exchanger according to claim 1, wherein the accommodation portion projects in a width direction of the one of the plurality of divided bodies.

5. The compound type heat exchanger according to claim 1, wherein the connection port is an inlet port of the flowing medium of the first heat exchanger, and the flowing medium of the first heat exchanger is cooled due to heat exchange between the flowing medium of the first heat exchanger and the flowing medium of the second heat exchanger.

6. The compound type heat exchanger according to claim 5, wherein the first heat exchanger is an intercooler, and the flowing medium of the second heat exchanger is a coolant of an engine cooling circuit.

7. The compound type heat exchanger according to claim 6, wherein a first discharge portion that is capable of discharging condensed water is provided on a bottom portion of the accommodation portion.

8. The compound type heat exchanger according to claim 7, wherein a second discharge portion that is capable of discharging condensed water is provided on a bottom portion of the at least one of the pair of tanks.

9. The compound type heat exchanger according to claim 1, wherein the connection port is an outlet port of the flowing medium of the first heat exchanger, and the flowing medium of the second heat exchanger is cooled due to heat exchange between the flowing medium of the first heat exchanger and the flowing medium of the second heat exchanger.

10. The compound type heat exchanger according to claim 9, wherein the first heat exchanger is a radiator, and the second heat exchanger is an oil cooler.

11. The compound type heat exchanger according to claim 1, wherein the accommodation portion communicates with another one of the plurality of divided bodies through a collection portion having an opening-space reduced passage.

12. The compound type heat exchanger according to claim 11, further comprising an adjustment means that can regulate a flow amount of the flowing medium of the first heat exchanger that flows in the tubes corresponding to the one of the plurality of divided bodies such that the flow amount is not more than a flow amount of the flowing medium of the first heat exchanger that flows in the tubes corresponding to the plurality of divided bodies other than the one of the plurality of divided bodies.

13. The compound type heat exchanger according to claim 12, wherein the adjustment means is an insertion member that is positioned in and fixed to end portions of the tubes corresponding to the one of the plurality of divided bodies.

14. The compound type heat exchanger according to claim 12, wherein the adjustment means is a deformed portion formed by decreasing an opening space of an end portion of the tubes corresponding to the one of the plurality of divided bodies.

15. The compound type heat exchanger according to claim 3, wherein the connection port is an inlet port of the flowing medium of the first heat exchanger, and the flowing medium of the first heat exchanger is cooled due to heat exchange between the flowing medium of the first heat exchanger and the flowing medium of the second heat exchanger.

16. The compound type heat exchanger according to claim 4, wherein the connection port is an inlet port of the flowing medium of the first heat exchanger, and the flowing medium of the first heat exchanger is cooled due to heat exchange between the flowing medium of the first heat exchanger and the flowing medium of the second heat exchanger.

17. The compound type heat exchanger according to claim 3, wherein the connection port is an outlet port of the flowing medium of the first heat exchanger, and the flowing medium of the second heat exchanger is cooled due to heat exchange between the flowing medium of the first heat exchanger and the flowing medium of the second heat exchanger.

18. The compound type heat exchanger according to claim 4, wherein the connection port is an outlet port of the flowing medium of the first heat exchanger, and the flowing medium of the second heat exchanger is cooled due to heat exchange between the flowing medium of the first heat exchanger and the flowing medium of the second heat exchanger.

19. The compound type heat exchanger according to claim 9, wherein the accommodation portion communicates with another one of the plurality of divided bodies through a collection portion having an opening-space reduced passage.

20. The compound type heat exchanger according to claim 1, wherein the accommodation portion surrounds a perimeter of the second heat exchanger.

* * * * *